US005704122A

United States Patent [19]

Tsubokawa et al.

[11] Patent Number: 5,704,122

[45] Date of Patent: Jan. 6, 1998

[54] SEALED-TYPE SCROLL COMPRESSOR AND ASSEMBLING METHOD THEREFOR

[75] Inventors: Masahiro Tsubokawa; Osamu Aiba, both of Kusatsu; Toshiharu Yasu, Yasu-gun; Shuichi Yamamoto, Otsu; Hideo Hirano; Taisei Kohayakawa, both of Kusatsu; Shozo Hase, Hikone, all of Japan

[73] Assignee: Matsushita Electric Industrial Co., Ltd., Osaka, Japan

[21] Appl. No.: 783,634

[22] Filed: Jan. 14, 1997

Related U.S. Application Data

[62] Division of Ser. No. 362,679, Dec. 22, 1994, Pat. No. 5,632,610.

[30] Foreign Application Priority Data

Dec. 24, 1993 [JP] Japan ..... 5-329132

[51] Int. Cl.[6] ..... B23P 15/00

[52] U.S. Cl. ..... 29/888.022; 418/55.2

[58] Field of Search ..... 29/888.022, 428; 418/55.2, 83

[56] References Cited

U.S. PATENT DOCUMENTS 3,884,599 5/1975 Young et al. ..... 418/55.3

4,773,835 9/1988 Machida et al. ..... 418/55.2

*Primary Examiner*—Irene Cuda

*Attorney, Agent, or Firm*—Panitch Schwarze Jacobs & Nadel, P.C.

[57] ABSTRACT

In a sealed-type scroll compressor having a stationary scroll member and an orbiting scroll member, the stationary scroll member is fixed after rotating it in an orbiting direction of the orbiting scroll member by a predetermined angle from a phase angle position where a possible orbiting radius between both scroll members is made maximum at the temperature before driving the scroll compressor.

2 Claims, 9 Drawing Sheets

SEALED-TYPE SCROLL COMPRESSOR AND ASSEMBLING METHOD THEREFOR

FIELD OF THE INVENTION AND RELATED ART STATEMENT

This is a division of application Ser. No. 08/362,679, filed Dec. 22, 1994, now U.S. Pat. No. 5,632,610.

1. FIELD OF THE INVENTION

The present invention relates to a sealed-type scroll compressor and its assembling method.

2. DESCRIPTION OF THE RELATED ART

The specification of U.S. Pat. No. 3,884,599 discloses a conventional scroll-type fluid machinery. This fluid machinery has a stationary scroll member and an orbiting scroll member which are formed to have involute-curved shapes. These scroll members are inwardly engaged with each other with their wraps facing together. The orbiting scroll member is driven by a crank shaft to make orbiting motion. Volume of a compressed gas space defined by two scroll members decreases in response to movement of the space toward the center of the scroll members caused by the orbiting motion in one direction which is hereinafter referred to as the orbiting direction.

In the above-mentioned scroll-type fluid machinery, generally, a pair of compressed gas spaces are defined by side walls of two wraps of the stationary scroll member and the orbiting scroll member. These compressed gas spaces are sealed by adjacent two wraps located closer to each other and gradually made smaller to increase a pressure in the gas space. Accordingly, positioning of both scroll members should be carried out with high accuracy.

To be concrete, the stationary scroll member should be located and fixed in a position where a proper minute gap is formed between adjacent two wraps of the stationary scroll member and the orbiting scroll member without making contact with each other at any rotational position around a crank axis.

The conventional method for assembling the sealed-type scroll compressor is disclosed in e.g., Japanese published patent application TOKKAI Hei 2-221693. According to the method disclosed in this publication, the orbiting scroll member sequentially makes orbiting motion to go to predetermined angular positions. In each of the predetermined angular positions, the stationary scroll member is moved until it makes contact with the orbiting scroll member. When the stationary scroll member has come into contact with the orbiting scroll member, X-position or Y-position is measured. Based on these X-positions and Y-positions, the position to which the stationary scroll member is to be located is determined. Further, by providing a θ-table on the XY-tables, it is possible to relatively position the stationary scroll member with respect to the orbiting scroll member in the orbiting direction of the orbiting scroll member.

FIG. 1 is a cross-sectional view showing a compressor chamber 1 of the scroll compressor. In FIG. 1, the stationary scroll member 4 is fixed with the frame 2 by a bolt 7. The orbiting scroll member 5 is driven by the crank shaft 3. A clearance "E" is formed between an inner face of a wrap 5*b* of the orbiting scroll member 5 and an outer face of a wrap 4*b* of the stationary scroll member 4. A clearance "F" is formed between an outer face of the wrap 5*b* of the orbiting scroll member 5 and an inner face of the wrap 4*b* of the stationary scroll member 4. What is important in assembling the compressor chamber is to locate the stationary scroll member 4 with respect to the orbiting scroll member 5 so that the clearances of "E" and "F" can be always constant at any rotational position of the crank shaft 3.

Hereupon, in the above mentioned sealed-type scroll compressor, what influence occurs on the positional relation between both scroll members by the thermal expansion will be described.

Under the condition that materials of the stationary scroll member 4 and the orbiting scroll member 5 are equal to each other in regard to their coefficients of thermal expansion, a clearance between both wraps 4*b* and 5*b* at the time of assembly is compared with a clearance after the thermal expansion has occurred. Further, a relative phase angle for obtaining the maximum clearance at the time of assembly is compared with that after the thermal expansion has occurred.

In that case, each configuration of both wraps 4*b* and 5*b* has expand in its radius of a base circle of the involute curve in response to an extent of temperature rise. Therefore, the clearance between both wraps 4*b* and 5*b* during the driving becomes larger than the initial set clearance. However, the relative phase angle for obtaining the maximum clearance is kept constant even when the thermal expansion has occurred. In the scroll compressors, the relative phase angle for obtaining the maximum clearance is constant even when radii of the base circles of the involute curves for the stationary scroll member 4 and the orbiting scroll member 5 are different from each other.

In recent years, employment of an inverter-controlled scroll compressor goes on increasing, and further high-speed diving of the compressor in comparison with the conventional one is being expected for higher efficiency and smaller size of the scroll compressor. Accordingly, to reduce the centrifugal force of the orbiting scroll member 5, reduction of weight of the orbiting scroll member 5 is making continuous progress.

In the above-mentioned circumstances, there often exists the case that a material of the stationary scroll member 4 is different from a material of the orbiting scroll member 5 in regard to a coefficient of the thermal expansion. The clearance between the two wraps 4*b*, 5*b* and the relative phase angle for obtaining the maximum clearance are both varied whenever radii of the base circles of the involute curves are equal to or different from each other. Therefore, even when the stationary scroll member 4 is fixed to the optimum position, a proper clearance cannot be held between both wraps 4*b* and 5*b* during the actual operation of the scroll compressor. As a result, freezing ability lowers, and an input power increases, thus lowering an efficiency of the scroll compressor.

Next, description will be made in detail about how the clearance is influenced by the thermal expansion of the scroll members 4 and 5.

FIGS. 7(*a*), 7(*b*), 8(*a*), 8(*b*), 9(*a*), 9(*b*), 10(*a*) and 10(*b*) are graphs each showing a relation between a possible orbiting radius (graduated on ordinate) and a relative phase angle (graduated on abscissa) between the stationary scroll member 4 (FIG. 1) and the orbiting scroll member 5 (FIG. 1). When a shift of phase is 180°, it is defined 0°. As shown in FIG. 3, a direction of positive is defined by a counter-orbiting direction of the orbiting scroll member 5 with respect to the stationary scroll member 4, and a direction of negative is defined by an orbiting direction of the orbiting scroll member 5. The term of "possible orbiting radius" is defined as an orbiting radius required to obtain a predetermined clearance between the stationary scroll member 4 and the orbiting scroll member 5, and the "orbiting radius" is defined as an eccentric distance between the center axis of the orbiting scroll member 4 and the center axis of the crank shaft 3 (FIG. 1).

As an example, description will be made hereinafter about the position of 0°. The description about the states of other phase angle sis omitted because it is similar to the following description.

In FIG. 7(*a*), a characteristic (a) is obtained under the condition: a material of the stationary scroll member 4 (FIG. 1) has the same coefficient of thermal expansion as a material of the orbiting scroll member 5 (FIG. 1); and radii of the base circles are equal to each other. In this characteristic, a relative phase angle $\theta_c$ presenting the maximum possible orbiting radius is 0°, and both scroll members 4 and 5 are coupled with each other with a predetermined clearance between the wraps 4*b* and 5*b* (FIG. 1).

When the stationary scroll member 4 is fixed with respect to the orbiting scroll member 5 within the positive domain, a predetermined clearance is formed between an inner side wall of the wrap 5*b* of the orbiting scroll member 5 and an outer side wall of the wrap 4*b* of the stationary scroll member 4, whereas a clearance larger than a predetermined value is formed between an outer side wall of the wrap 5*b* of the orbiting scroll member 5 and an inner side wall of the wrap 4*b* of the stationary scroll member 4. When the stationary scroll member 4 is fixed with respect to the orbiting scroll member 5 within the negative domain, there arises a reverse state to the above-mentioned state occurred in the positive domain.

When the scroll compressor is driven after the stationary scroll member 4 has been assembled in the state of the relative phase angle 0°, radii of the base circles of both scroll members 4 and 5 expands due to the thermal expansion. However, since the coefficients of thermal expansion are equal to each other, a relative phase angle $\theta_H$ presenting the maximum possible orbiting radius is still 0° ($=\theta_c$) as shown in a characteristic (b) in FIG. 7(*b*). Thus, although the clearance between the wraps 4*b* and 5*b* slightly expands due to the thermal expansion, an optimum positional relationship between both scroll members 4 and 5 is maintained.

Next, in FIG. 8(*a*) a characteristic (a) is obtained under the condition: a material of the stationary scroll member 4 has the same coefficient of thermal expansion as a material of the orbiting scroll member 5: and radii of the base circles are different from each other. In this state, the maximum possible orbiting radius appears in a relative phase angle away from 0°. The angle $\theta_c$ is not zero degree.

When a radius of the base circle of the scroll member 5 is smaller than a radius of the base circle of the stationary scroll member 4, the relative phase angle presenting the maximum possible orbiting radius moves toward the negative domain ($\theta_c<0°$). When a radius of the base circle of the orbiting scroll member 5 is larger than the radius of the base circle of the stationary scroll member 4, the relative phase angle presenting the maximum possible orbiting radius moves toward the positive domain ($\theta_c>0°$).

When the scroll compressor is driven after the stationary scroll member 4 has been assembled in the state of the relative phase angle $\theta_c$, radii of the base circles of both scroll members 4 and 5 expand due to the thermal expansion. However, since the coefficients of thermal expansion are equal to each other, a relative phase angle $\theta_H$ presenting the maximum possible orbiting radius is equal to the angle $\theta_c$, which is the angle at the time of the assembly, as shown in a characteristic (b) in FIG. 8(*b*). Thus, although the clearance between the wraps 4*b* and 5*b* slightly expands due to the thermal expansion, an optimum positional relationship between both scroll members 4 and 5 is maintained.

Thus, even after the thermal expansion has occurred, the relative phase angle presenting the maximum possible orbiting radius is kept equal to that at the time of assembly only on condition that coefficients of thermal expansion of materials for both scroll members 4 and 5 are equivalent to each other. In other words, the relative phase angle does not vary whenever radii of the base circles are equal to or different from each other. Therefore, a state of clearance between both wraps 4*b* and 5*b* is maintained substantially as it is in the assembly.

However, when the coefficients of thermal compression of the materials for both scroll members 4 and 5 are different from each other, a state of clearance between the wraps 4*b* and 5*b* varies after the thermal expansion as compared with the state in the assembly. FIGS. 9(*a*) and 9(*b*) are graphs showing relations between the resistive phase angle and the possible orbiting radius. A characteristic (a) is obtained on condition that: materials of the scroll members 4 and 5 are different from each other in regard to coefficients of thermal expansion: and radii of the base circles of both scroll members 4 and 5 are equal to each other. The maximum possible orbiting radius is obtained in a position where the relative phase angle $\theta_C$ is zero degree. This characteristic (a) is similar to the characteristic (a) shown in FIG. 7(*a*).

When the scroll compressor is driven under the condition that both scroll members 4 and 5 are assembled with a relative phase angle of 0°, radii of the base circles of both scroll members 4 and 5 expand due to the thermal expansion. At that time, since the coefficient of thermal expansion are different from each other, a radius of the base circle of the stationary scroll member 4 is different from that of the orbiting scroll member 5 after the thermal expansion has occurred. As a result, the relative phase angle $\theta_H$ presenting the maximum possible orbiting radius is shifted from the angle $\theta_C$ (=0°) at the time of the assembly as shown in a characteristic (b) in FIG. 9(*b*). When the coefficient of the thermal expansion in the orbiting scroll member 5 is larger than that in the stationary scroll member 4, the relative phase angle $\theta_H$ sifts to the positive domain (i.e., $\theta_C<\theta_H$) as shown in the characteristic (b) in FIG. 9(*b*). When the coefficient of the thermal expansion in the orbiting scroll member 5 is smaller than that in the stationary scroll member 4, the relative phase angle $\theta_H$ shifts to the negative domain (i.e., $\theta_C>\theta_H$).

In the characteristic (b) in FIG. 9(*b*), the relative phase angle ($\theta_C=0°$) in the assembly is positioned in the negative side (i.e., $\theta_C<\theta_H$) from the relative phase angle $\theta_H$ which presents the maximum possible orbiting radius after the thermal expansion has occurred. Therefore, a clearance between the inner side wall of the wrap 5*b* of the orbiting scroll member 5 and the outer side wall of the wrap 4*b* of the stationary scroll member 4 is larger than a predetermined value, and a clearance between the outer side wall of the wrap 5*b* of the orbiting scroll member 5 and the inner side wall of the wrap 4*b* of the stationary scroll member 4 is smaller than a predetermined value.

As a result, the condition at the time of assembly can not be maintained, thus lowering performance of the scroll compressor. Further, depending on the present clearance, the side walls of the wraps 4*b* and 5*b* may come into contact with each other after the thermal expansion has occurred, thereby undesirably applying the wraps 4*b* and 5*b* with an excessive force. As a result, the input power increases, or the scroll compressor stops. Further, the wraps 4b and 5b may be destroyed. Thus, the reliability of the scroll compressor lowers.

FIGS. 10(*a*) and 10(*b*) are also graphs showing relations between the relative phase angle (on abscissa) and the possible orbiting radius (on ordinate). These characteristics (a) and (b) are obtained under the condition that: materials of the scroll members are different from each other in regard to the coefficients of thermal expansion: and radii of the base circles of both scroll members 4 and 5 are different from each other. As has been made the similar description for the characteristic (a) in FIG. 8(*a*), the maximum possible orbiting radius is obtained at a relative phase angle $\theta_C$ ($\neq 0°$) which is shifted from 0°. When the radius of the base circle of the orbiting scroll member 5 is smaller than that of the stationary scroll member 4, the relative phase angle $\theta_C$ presenting the maximum possible orbiting radius shifts to the negative domain (i.e., $\theta_C < 0°$). When the radius of the base circle of the orbiting scroll member 5 is larger than that of the stationary scroll member 4, the relative phase angle $\theta_C$ presenting the maximum possible orbiting radius shifts to the positive domain (i.e., $\theta_C > 0°$).

In this state, when the scroll compressor is driven, the radii of the base circles of both scroll members 4 and 5 expand due to the thermal expansion. Since the coefficients of thermal expansion of both scroll members 4 and 5 are different from each other, the radii of the base circles of the stationary scroll member 4 and the orbiting scroll member 5 become respective other values or may accidentally be equal to each other in a specific condition. However, as shown in a characteristic (b) in FIG. 10(*b*), the relative phase angle $\theta_H$ ($+\theta_C$) presenting the maximum possible orbiting radius is shifted from the position of the angle $\theta_C$ in the assembly.

Thus, in the condition such that coefficients or thermal expansion of the materials for both scroll members 4 and 5 are different from each other, the relative phase angle presenting the maximum possible orbiting radius varies after the thermal expansion as compared with that in the assembly whenever the radii of the base circles are equal to or different from each other. Therefore, the clearance between both wraps 4b and 5b varies as compared with the value of initial setting. The desirable condition at the time of assembly is thus not maintained, resulting in lowering performance of the scroll compressor. Further, depending on the present clearance, the sidewalls of the wraps 4b and 5b may come into contact with each other after the thermal expansion has occurred. Such contact will damage the wraps 4b and 5b, and the reliability of the scroll compressor lowers accordingly.

OBJECT AND SUMMARY OF THE INVENTION

An object of the present invention is to offer a sealed-type scroll compressor and its assembling method by which both scroll members are precisely positioned to make a condition of the positional relation optimum even when the temperature rises in the scroll members having coefficients of thermal expansion different from each other.

In order to achieve the above-mentioned object, the sealed-type scroll compressor of the present invention comprises a compression chamber consisting of a stationary scroll member and an orbiting scroll member, both of which are engaged with each other with inner faces of respective wraps facing to each other, the stationary scroll member and the orbiting scroll member being made of materials whose coefficients of thermal expansion are different from each other, wherein an improvement is that:

the stationary scroll member and the orbiting scroll member are located in position by relatively shifting one of scroll members having a coefficient of thermal expansion larger than the other scroll member by a predetermined phase angle in a counter-orbiting direction of the orbiting scroll member from a position defined by a predetermined positional relationship between the stationary scroll member and the orbiting scroll member where a possible orbiting radius between the stationary scroll member and the orbiting scroll member is made maximum.

In another aspect, the present invention is a method for assembling a sealed type scroll compressor having a stationary scroll member to be fixed to a frame and an orbiting scroll member to be engaged with said stationary scroll member, the method comprising the steps of:

temporarily positioning the stationary scroll member on the frame to come into engagement with the orbiting scroll member;

relatively positioning one of the scroll members with respect to the other scroll member in a phase angle direction of wraps of the scroll members;

positioning the stationary scroll member with respect to the orbiting scroll member in X-direction and Y-direction of the scroll members;

shifting one of the scroll members, which has a coefficient of thermal expansion smaller than the other scroll member, in an orbiting direction of the orbiting scroll member, in an orbiting direction of the orbiting scroll member by a predetermined phase angle; and fixing the stationary scroll member to the frame.

According to the present invention, the clearance between both scroll members is kept optimum in condition in any orbiting direction during the driving of the scroll compressor. Accordingly, power loss in the compression chamber is reduced without any improvement in accuracy of parts, and performance of the scroll compressor is therefore improved.

While the novel features of the invention are set forth particularly in the appended claims, the invention, both as to organization and content, will be better understood and appreciated, along with other objects and features thereof, from the following detailed description taken in conjunction with the drawings.

It will be recognized that some or all of the Figures are schematic representations for purposes of illustration and do not necessarily depict the actual relative sizes or locations of the elements shown.

DESCRIPTION OF THE PREFERRED EMBODIMENT

Hereafter, a preferred embodiment of the present invention will be described with reference to the accompanying drawings.

Figure 1:
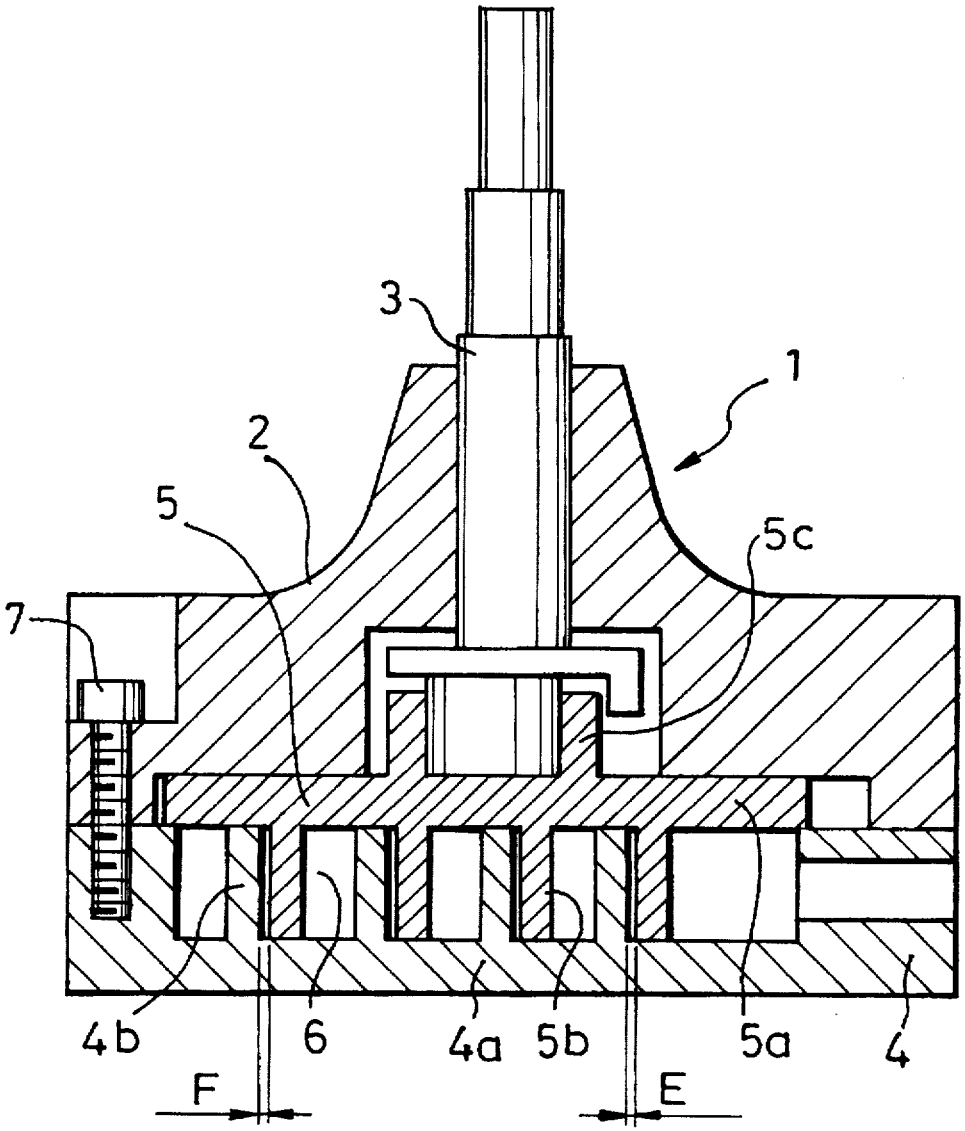
FIG. 1 is a cross-sectional view showing a compression chamber of a sealed-type scroll compressor.

FIG. 1 is a cross sectional view showing a compressor chamber 1 of the scroll compressor. In FIG. 1, a stationary scroll member 4 is to be fixed with a frame 2 by a bolt 7. An orbiting scroll member 5 is driven by a crank shaft 3. A clearance "E" is formed between an inner face of a wrap 5*b* of the orbiting scroll 5 and an outer face of a wrap 4*b* or the stationary scroll 4. A clearance of width "F" is formed between an outer face of the wrap 5*b* of the orbiting scroll member 5 and an inner face of the wrap 4*b* of the stationary scroll member 4. What is important in assembling the compressor chamber is to fix the stationary scroll member 4 to the orbiting scroll member 5 so that the clearances of "E" and "F" can be always constant at any rotational position of the crank shaft 3. The stationary scroll member 4 and the orbiting scroll member 5 are engaged with each other, thereby defining a compression space 6 therebetween. The stationary scroll member 4 consists of a disc-shaped and plate 4*a* and an upright wrap 4*b* which is formed to have an involute curve. A radius of a base circle of the involute curve is defined "$a_T$", and a coefficient of thermal expansion of a material of the stationary scroll member 4 is defined "$K_T$". The orbiting scroll member 5 consists of a disc-shaped and plate 5*a*, an upright wrap 5*b* and a boss member 5*c* formed on a face reverse to the wrap 5*b* of the end plate 5*a*. The wrap 5*b* is formed to have an involute curve in which a radius of a base circle is defined "$a_D$". A coefficient of thermal expansion of a material of the orbiting scroll member 5 is defined "$K_D$", and this is larger than the above-mentioned coefficient $K_T$ of the stationary scroll member 4.

When a temperature of the stationary scroll member 4 and the orbiting scroll member 5 rises uniformly by T° C. during the driving, the radius $a_T$ of the wrap 4*b* and the radius $a_D$ of the wrap 5*b* hold the following equations:

$$a_T\times(1+K_T\times T)=a_D\times(1+K_D\times T)=a_H.$$

Under the relation of $K_T<K_D$, the above equation necessarily introduces a relation of $a_T>a_D$. As shown in the above-noted notations, the stationary scroll member 4 rising by T° C. and the orbiting scroll member 5 rising by T° C. are set to have the same radius, designated $a_H$.

Heretofore, a method for assembling the scroll compressor will be described with reference to FIGS. 11 and 12.

Figure 11:
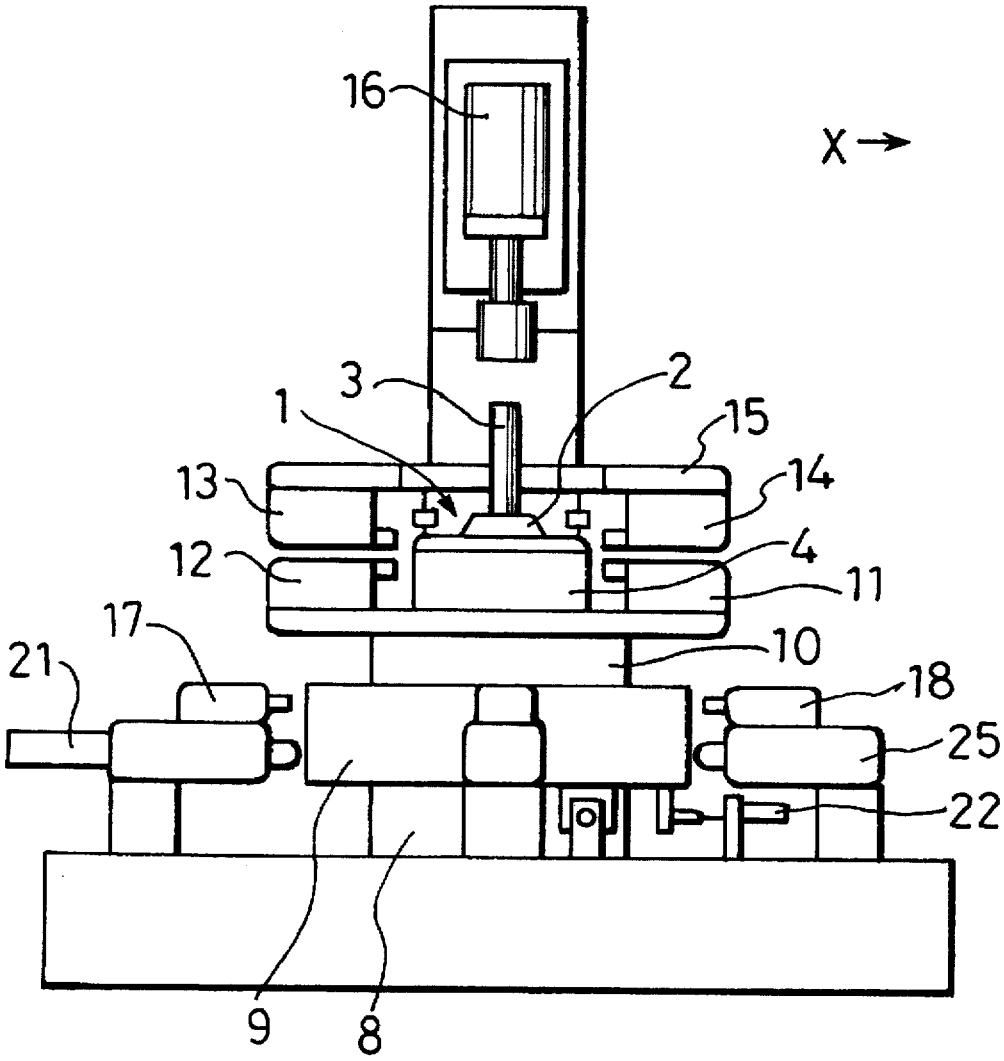
FIG. 11 is a front view showing a positioning apparatus for the scroll compressor.
Figure 12:
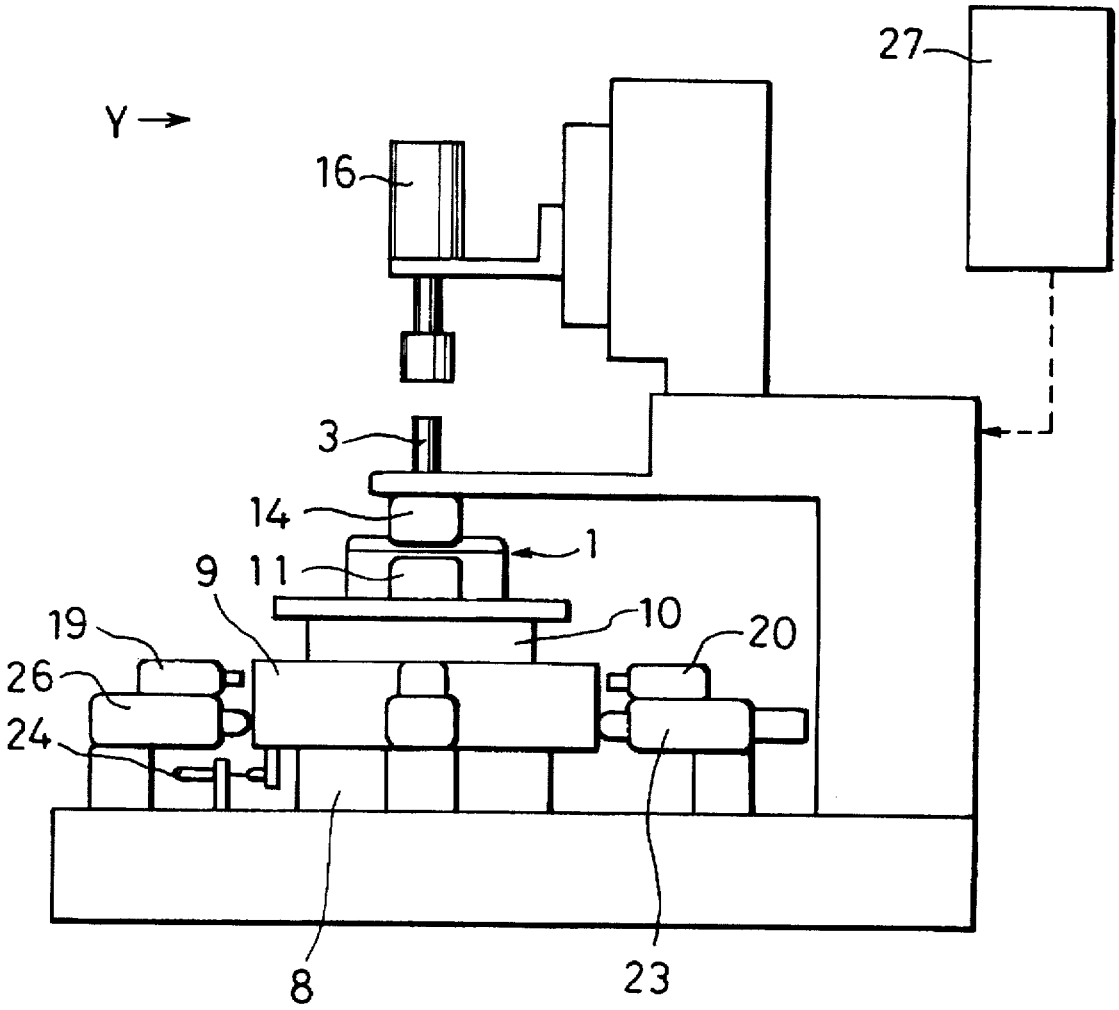
FIG. 12 is a side view showing the positioning apparatus shown in FIG. 11.

FIG. 11 is a front view showing an assembling machine of the scroll compressor, and FIG. 12 is a side view showing the same assembling machine. In FIG. 11 or FIG. 12, an X-table 9 is provided on a Y-table 8, and a θ-table 10 is provided on the X-table 9. A first chuck member 11 and a second chuck member 12 are provided above the θ-table 10 on opposite sides to each other so as to chuck therebetween the stationary scroll member 4 which is put on the θ-table 10. A third chuck member 13 and a fourth chuck member 14 are provided similarly to the above so as to chuck therebetween a frame 2. A crank axis revolving unit 16 is provided to go downward, grip and revolve a crank axis 3. A first pushing member 17 is provided to push the X-table 9 and the Y-table 8 from a negative side of the X-direction, and a second pushing member 18 is provided to push the X-table 9 and the Y-table 8 from a positive side of the X-direction. A third pushing member 10 (FIG. 12) is provided to push the X-table 9 and the Y-table 8 from a negative side of the Y-direction, and a fourth pushing member 20 (FIG. 12) is provided to push the X-table 9 and the Y-table 8 from a positive side of the Y-direction. A driving unit 21 (FIG. 11) for the X-direction is provided to move the X-table 9 and the Y-table 8 in the X-direction, and a position detector 22 for the X-direction measures a moved amount of the X-table 0 and detects a position in the X-direction. A driving unit 23 (FIG. 12) for the Y-direction is provided to move the X-table 9 and the Y-table 8 in the Y-direction, and a position detector 34 for the Y-direction measures a moved amount of the Y table 8 and detects a position in the Y-direction. A pushing rod 25 (FIG. 11) for the X-direction is provided to fixedly hold the X-table 0 and the Y-table 8 against a force given by the driving unit 21 for the X-direction. A pushing rod 26 (FIG. 12) for the Y-direction is provided to fixedly hold the X-table 9 and the Y-table 8 against a force given by the driving unit 23 for the Y-direction. Based on the positions detected, a control unit 27 (FIG. 12) calculates a clearance and a position to be located and operates respective actuators (not shown).

Next, a method for assembling the scroll compressor will be described with reference to FIGS. 1, 4, 5 and 6.

FIG. 4 is illustrations showing a positional relationship between the stationary scroll member 4 and the orbiting scroll member 5 in four angular positions of 0°, 90°, 180° and 270° when the crank shaft 3 (FIG. 1) is revolved.

To carry out the assembly of the compression chamber of the scroll compressor in FIGS. 11 and 12, the first step is to put on the θ-table 10 the compression chamber 1 with the bolt 7 being released. The stationary scroll member 4 is fixedly held by the first chuck member 11 and the second chuck member 12 therebetween, and the frame 2 is fixedly held by the third chuck member 13 and the fourth chuck member 14 therebetween. Further, the crank axis revolving unit 16 is lowered to grip the crank shaft 3. Next, the crank axis 3 is revolved to make a positional relationship of the orbiting scroll member 5 and the stationary scroll member 4 into a state of 0° shown in FIG. 4.

Figure 5:
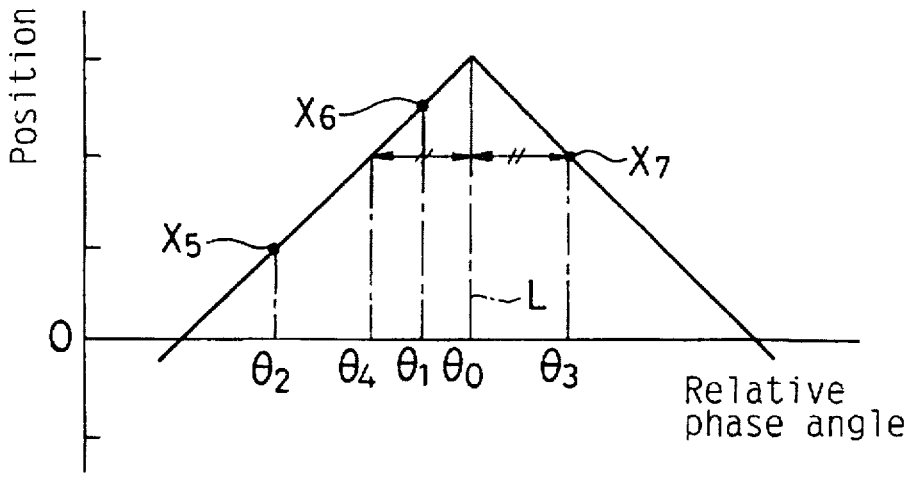
FIG. 5 is a graph showing a relation between the relative phase angle of the stationary scroll member with respect to the orbiting scroll member and positions in the X-direction.
Figure 6:
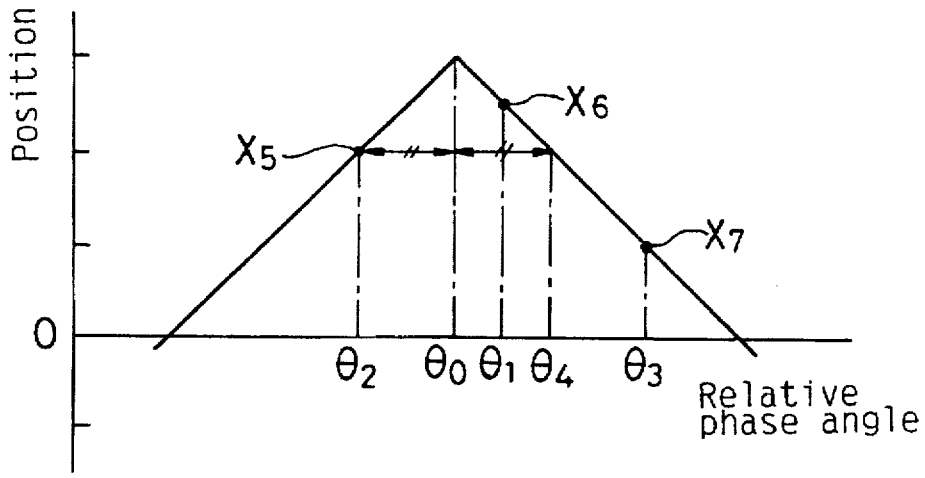
FIG. 6 is a graph showing a relation between the relative phase angle of the stationary scroll member with respect to the orbiting scroll member and positions in the X-direction.
Figure 7A:
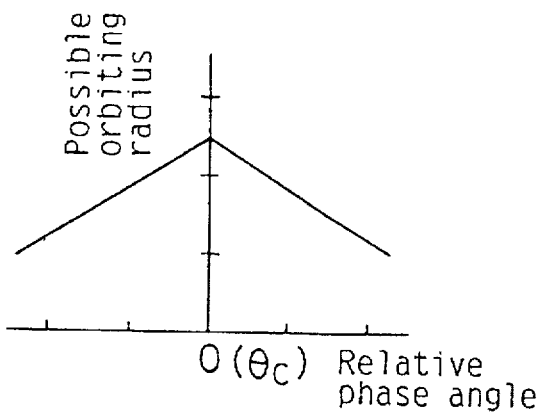
FIGS. 7(*a*) and 7(*b*) are graphs showing characteristics of a possible orbiting radius versus relative phase angle.
Figure 7B:
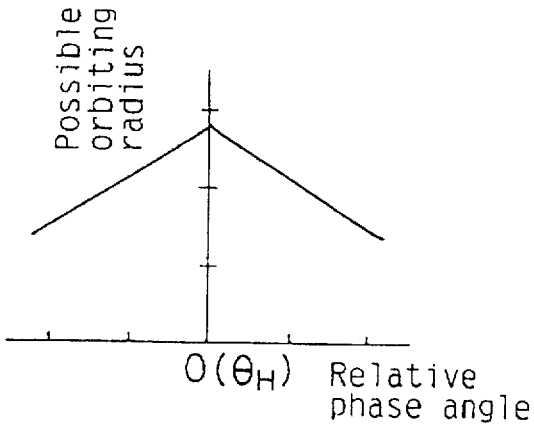
Figure 8A:
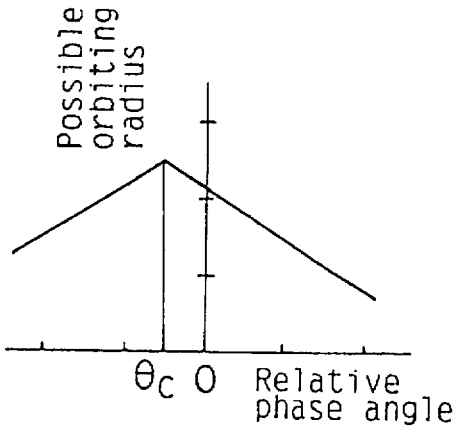
FIGS. 8(*a*) and 8(*b*) are graphs is a graph showing characteristics of a possible orbiting radius versus phase angle.
Figure 8B:
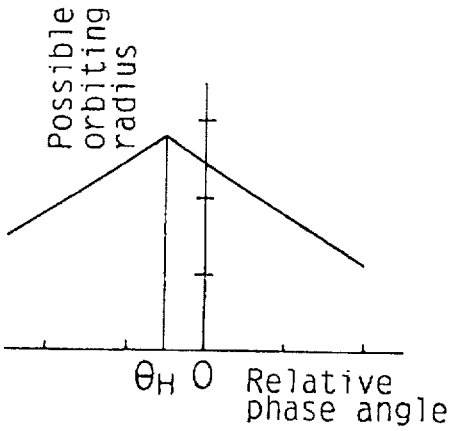
Figure 9A:
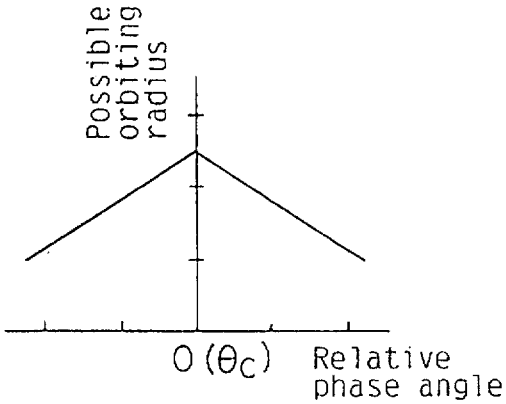
FIGS. 9(*a*) and 9(*b*) are graphs showing characteristics of a possible orbiting radius versus phase angle.
Figure 9B:
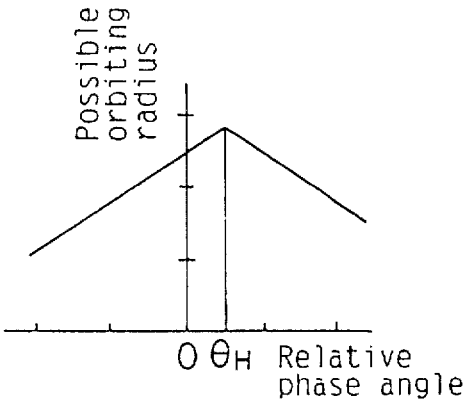

FIGS. 5 and 6 are graphs showing a relation between the relative phase angle of the stationary scroll member 4 with respect to the orbiting scroll 5 and positions in the X-direction. First, an angle $\theta_1$ is assumed as the maximum-clearance relative phase angle $\theta_0$. Next, around the phase angle $\theta_1$ which is as the center position, the stationary scroll member 4 is sequentially rotated to two angular positions of a phase angle $\theta_2$ in a negative direction and a phase angle $\theta_3$ in a positive direction, wherein an angle of $|\theta_2-\theta_1|$ is equal to an angle of $|\theta_3-\theta_1\equiv1$. In each of the angular positions, the stationary scroll member 4 is pushed toward the orbiting scroll member 5 by the first pushing member 17 (FIG. 11), and thereafter the fixed pushing member 17 returns to the home position. In a state that the stationary scroll member 4 is in contact with the orbiting scroll member 5, a position in the X-direction is detected by the detector 22 for the X-direction. Thus, three positions $X_{5\%}$, $X_6$ and $X_7$ which correspond to the phase angles $\theta_2$, $\theta_1$ and $\theta_3$ are detected by the detector 22. Since the relation has been known to have an isosceles-triangular mountain-shaped lines symmetrical with respect to a chain line L (FIG. 5) on the phase angle $\theta_0$, the phase angle $\theta_0$ presenting the maximum clearance can be derived from the mountain-shaped lines assumed.

In FIG. 5, the relative phase angle $\theta_0$ is within a range from the phase angle $\theta_1$ to the phase angle $\theta_3$, and a value of the position $X_6$ is smaller than a value of the position $X_7$.

First, a phase angle $\theta_4$ at which a value in the X-direction is equal to $X_7$ is detected by means of the following equation:

$$\theta_4 = \theta_2 + \frac{(X_7 - X_5) \times (\theta_1 - \theta_2)}{(X_6 - X_5)} .$$

The relative phase angle $\theta_0$ which is located in the middle of the phase angles $\theta_4$ and $\theta_3$ is represented by an equation:

$$\theta_0=(\theta_4+\theta_3)/2.$$

FIG. 6 is a graph showing another relationship in a state that the relative phase angle $\theta_0$ presenting the maximum clearance falls within a range from the phase angle $\theta_1$ to the phase angle $\theta_2$. In FIG. 6, a value of the position $X_5$ is larger than the value $X_7$.

First, a phase angle $\theta_4$ at which a value in the X-direction is equal to $X_5$ is detected by means of the following equation:

$$\theta_4 = \theta_3 + \frac{(X_5 - X_7) \times (\theta_3 - \theta_1)}{(X_6 - X_7)} .$$

The relative phase angle $\theta_0$ which is located in the middle of the phase angle $\theta_4$ and $\theta_2$ is represented by an equation:

$$\theta_0=(\theta_4+\theta_2)/2.$$

First, an angle $\theta_1$ is assumed as the relative phase angle $\theta_0$ presenting the maximum clearance. Next, around the phase angle $\theta_1$ which is as the center position, the stationary scroll member 4 is sequentially rotated to two angular positions of a phase angle $\theta_2$ in a negative direction and a phase angle $\theta_3$ in a positive direction, wherein an angle of $|\theta_2-\theta_1|$ is equal to an angle of $|\theta_3-\theta_1|$. Further, in the positional relation of 0° shown in FIG. 4, the stationary scroll member 4 is pushed toward the orbiting scroll member 5 by the first pushing member 17 (FIG. 11), and thereafter the fixed pushing member 17 returns to the home position. After that, position in the X-direction is detected. Based on a fact that position in the X-direction varies in a linear shape, the relative phase angle $\theta_0$ presenting the maximum clearance can be detected by obtaining at least three positions in the X-direction.

Relative phase angle to be held between the stationary scroll member 4 and the orbiting scroll member 5 is thus determined.

Next, positioning in the X- and Y-directions will be described. First, the crank shaft 3 (FIG. 1) is revolved to get the positional relation between the orbiting scroll member 5 and the stationary scroll member 4 into the state of 0° shown in FIG. 4(*a*). The X-table 9 (FIG. 11) is pushed toward the positive side by the first pushing member 17 (FIG. 11), thereby getting the stationary scroll member 4 into contact with the orbiting scroll member 5. When the first pushing member 17 is restored to the home position thereby making the pushing force zero, the stationary scroll member 4 is naturally in contact with the orbiting scroll 5. A position in the X-direction in this contacting state is detected by the detector 22 for the X-direction, and the detected position in the X-direction is stored in the control unit 27 (FIG. 12) as $X_1$.

Next, the crank shaft 3 is revolved by 90°, thereby getting the positional relation between the stationary scroll member 4 and the orbiting scroll member 5 into the state of 90° shown in FIG. 4(*a*). Further, the Y-table 8 (FIG. 12) is pushed toward the positive side by the third pushing member 19 (FIG. 12), thereby getting the stationary scroll member 4 into contact with the orbiting scroll member 5. When the stationary scroll member 4 comes into contact with the orbiting scroll 5, the third pushing member 19 is restored to the home position. In the state wherein the stationary scroll member 4 is naturally in contact with the orbiting scroll member 5, a position in the Y direction of the Y-table 8 is detected by the detector 24 (FIG. 12) for the Y-direction. The detected position in the Y-direction is stored in the control unit 27 (FIG. 12) as $Y_1$.

Next, the crank shaft 3 is revolved again by 90° to get the positional relation between the orbiting scroll member 5 and the stationary scroll member 4 into the state of 180° shown in FIG. 4(*c*). The X-table 9 (FIG. 11) is pushed toward the negative side by the second pushing member 18 (FIG. 11), thereby getting the stationary scroll member 4 into contact with the orbiting scroll member 5. Thereafter the second pushing member 18 is restored to the home position. A position in the X-direction in this contacting state is detected by the detector 22 (FIG. 11) for the X-direction, and the detected position in the X-direction is stored in the control unit 27 (FIG. 12) as $X_2$.

Next, the crank shaft 3 is revolved again by 90°, thereby getting the positional relation between the stationary scroll member 4 and the orbiting scroll member 5 into the state of 270° shown in FIG. 4(*d*). Further, the Y-table 8 (FIG. 12) is pushed toward the negative side by the fourth pushing member 20 (FIG. 12), thereby getting the stationary scroll member 4 into contact with the orbiting scroll member 5. When the stationary scroll member 4 comes into contact with the orbiting scroll 5, the fourth pushing member 20 is restored to the home position. In the state wherein the stationary scroll member 4 is naturally in contact with the orbiting scroll member 5, a position in the Y-direction of the Y table 8 is detected by the detector 24 (FIG. 12) for the Y-direction. The detected position in the Y-direction is stored in the control unit 27 (FIG. 12) as $Y_2$.

Next, base on the data $X_1$, $X_2$, $Y_1$ and $Y_2$, clearances $C_X$ (X-direction) and $C_Y$ (y-direction) between the two wraps 4*b* and 5*b* (FIG. 1) and a position (X, Y) to be located are determined by the following equations:

$$C_X=(X_1-X_2)/2,$$

$$C_Y=(Y_1-Y_2)/2,$$

$$X-X_2+(X_1-X_2)/2, \text{ and}$$

$$Y-Y_2+IY_1\ Y_2)/2.$$

Next, the X-table 9 (FIGS. 11 and 12) and the Y-table 10 (FIGS. 11 and 12) are moved by means of the driving unit 21 (FIG. 11) for the X-direction and the driving unit 23 (FIG. 12) for the Y-direction, thereby locating the stationary scroll member 4 into the above-mentioned position. Thereafter, the X-table 9 and the Y-table 10 are fixedly held by the pushing rod 25 (FIG. 11) for the X-direction and the pushing rod 26 (FIG. 12) for the Y-direction.

Figure 2:
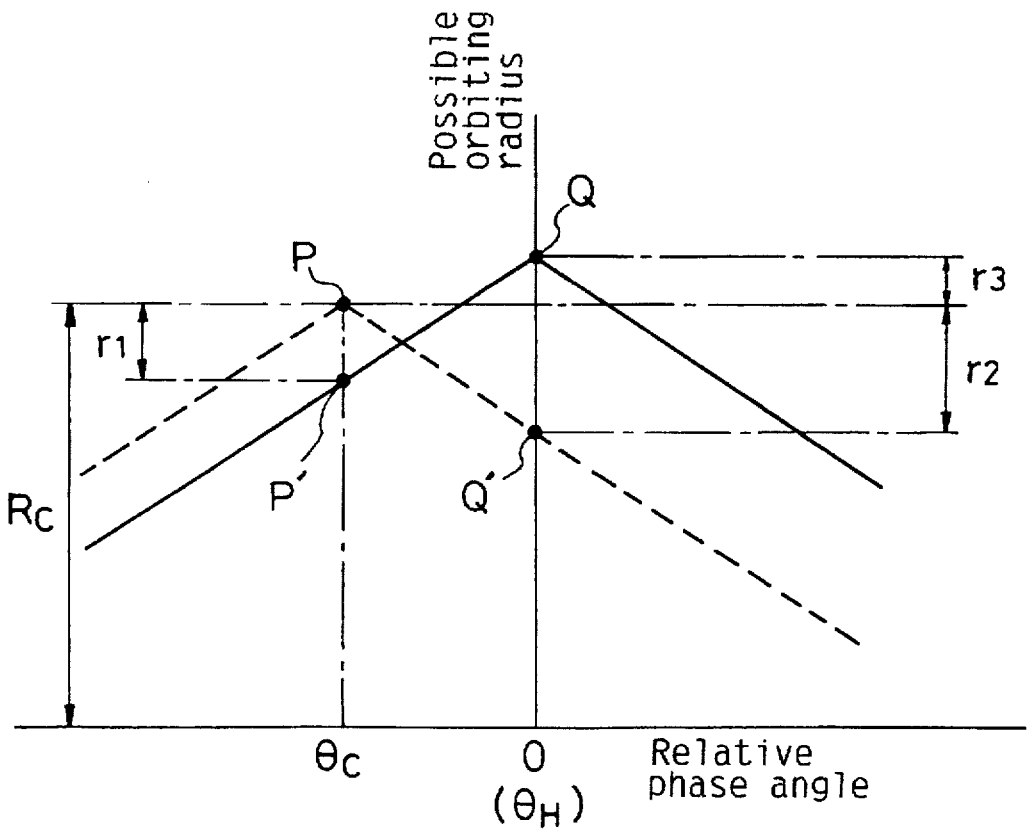
FIG. 2 is a graph showing characteristics of a possible orbiting radius versus relative phase angle.
Figure 3:
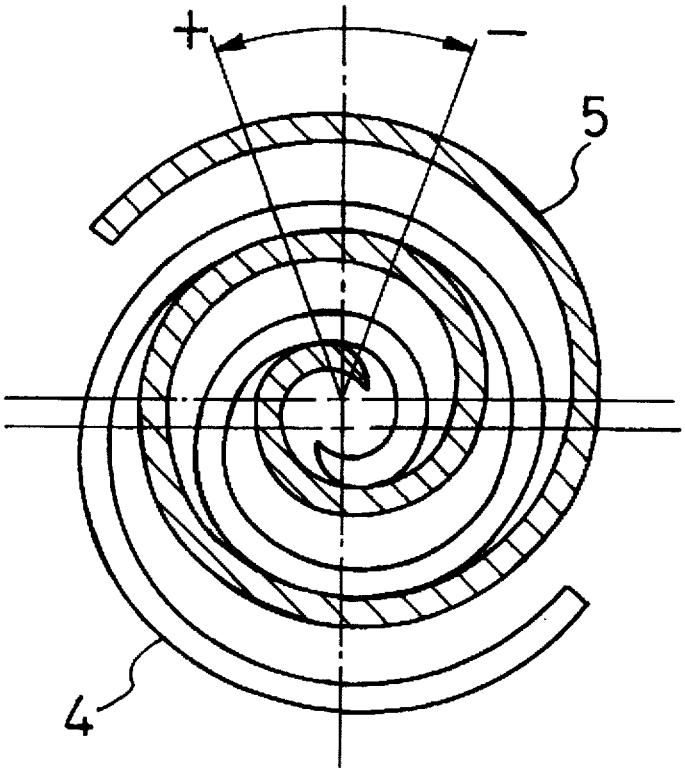
FIG. 3 is an illustration showing directions of a relative phase angle of an orbiting scroll member.
Figure 4A:
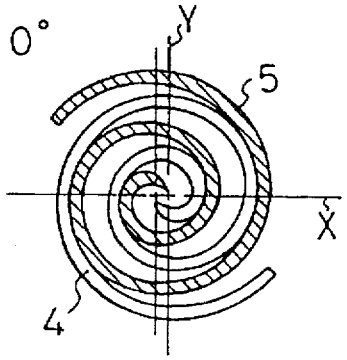
FIG. 4(*a*)–4(*d*) are is illustrations showing positional relations of a stationary scroll member and the orbiting scroll member.
Figure 4B:
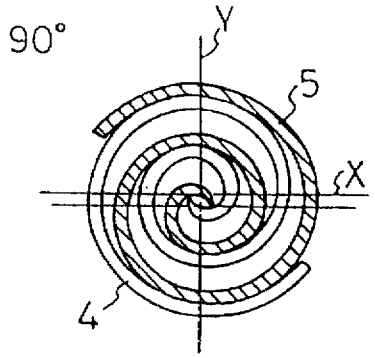
Figure 4C:
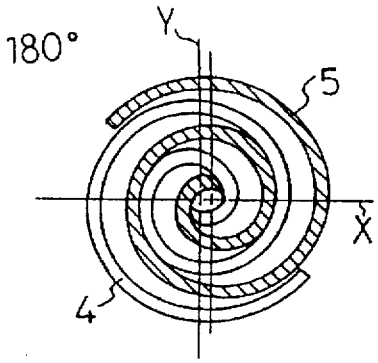
Figure 4D:
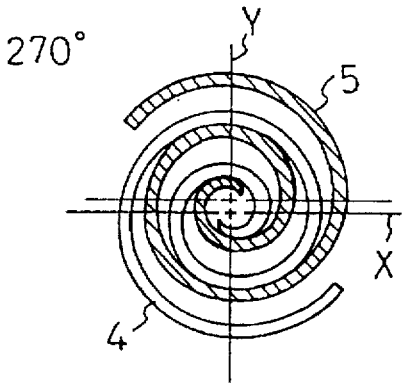
Figure 10A:
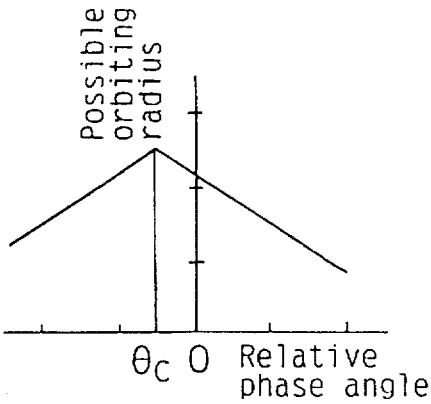
FIGS. 10(*a*) and 10(*b*) are graphs is a graph showing characteristics of a possible orbiting radius versus phase angle.
Figure 10B:
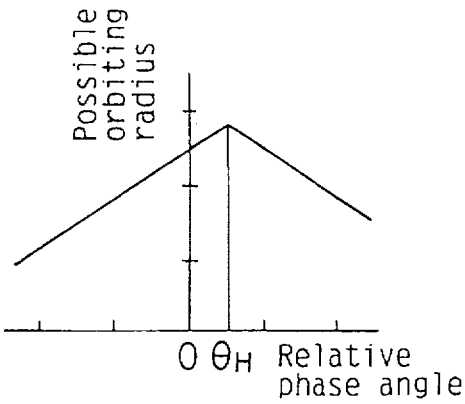

The state after completion of the above-mentioned procedures corresponds to the position P on a dotted line in FIG. 2. Since the radius $a_T$ is larger than the radius $a_D$, a relative phase angle $\theta_c$ (=$\theta_0$, in FIGS. 5 and 6) presenting the maximum possible orbiting radius is shifted to the negative domain as shown in the characteristic (a) of FIG. 10(*a*). In FIG. 2, an orbiting radius is $R_c$. Clearance between both scroll members 4 and 5 are uniformly of the predetermined clearance $C_c$.

When the temperature rises by T° C., the present state is represented by a position P' on a solid line of FIG. 2. Radii of the base circle of both scroll members 4 and 5 become to $a_H$ due to the thermal expansion, and their configurations of the base circles are equal to each other. However, since the relative phase angle $\theta_c$ is located in the negative side from a relative phase angle $\theta_H$ (=0°) presenting the maximum possible orbiting radius after the temperature has risen, a clearance between the outer side wall of the wrap 5*b* of the orbiting scroll member 5 and the inner side wall of the wrap 4*b* of the stationary scroll member 4 is smaller than the predetermined clearance $C_c$, whereas a clearance between the inner side wall of the wrap 5*b* of the orbiting scroll member 5 and the outer side wall of the wrap 4*b* of the stationary scroll member 4 is larger than the predetermined clearance $C_c$. Its difference is $r_1$ shown in FIG. 2.

In view of above, to make the clearance between both wraps 4 and 5 substantially equal to each other after the thermal expansion, the stationary scroll member 4 is rotated with the θ-table 10 to the negative direction (i.e., orbiting direction) by an angle of $\theta_c$. This means to relatively rotate the orbiting scroll member 5 to the positive direction (i.e., counter-orbiting direction) by the same angle. Then, the present state is represented by a position Q' on the dotted line in FIG. 2. In this state, a clearance between the outer side wall of the wrap 5*b* of the orbiting scroll member 5 and the inner side wall of the wrap 4*b* of the stationary scroll member 4 is larger than the predetermined clearance $C_c$, whereas a clearance between the inner side wall of the wrap 5*b* of the orbiting scroll member 5 and the outer side wall of the wrap 4*b* of the stationary scroll member 4 is smaller than the predetermined clearance $C_c$. Its difference is $r_2$ shown in FIG. 2.

In the above mentioned state, when the temperature rises by T° C., the present state is represented by a position Q on the solid line of FIG. 2. Radii of the base circles of both scroll members 4 and 5 become to $a_H$ due to the thermal expansion, and their configurations of the base circles are equal to each other. Further, since the relative phase angle $\theta_C$ shifts to the relative phase angle $\theta_H$ (=0) currently presenting the maximum possible orbiting radius, clearances between both wraps 4*b* and 5*b* are secured even with each other, thereby presenting the ideal positional relationship. Of course, the clearance becomes slightly larger than the predetermined clearance $C_c$ because of the thermal expansion. This expansion results in increase of orbiting radius $r_3$ shown in FIG. 2. However, this increase of radius $r_3$ brings no problem only by taking it into consideration in setting the clearance $C_c$ beforehand.

Finally, the X-table 9 (FIG. 11) and the Y-table 8 (FIG. 11) are fixedly held by the pushing rod 25 (FIG. 11) for the X-direction and the pushing rod 26 (FIG. 12) for the Y-direction. Thereafter, the bolt 7 is fixed, thereby completing the assembly.

In the scroll compressor assembled by the above-mentioned procedure, the radius of the base circle of the orbiting scroll member 5 is smaller than that of the stationary scroll member 4 before driving the scroll compressor. However, since the radii of the base circles of both scroll members 4 and 5 become equal to each other at the temperature under the driving, it is possible to keep the clearance in very good state during the important actual driving state. Performance of the scroll compressor is thereby improved.

Although the present invention has been described in terms of the presently preferred embodiments, it is to be understood that such disclosure is not to be interpreted as limiting. Various alterations and modifications will no doubt become apparent to those skilled in the art to which the present invention pertains, after having read the above disclosure. Accordingly, it is intended that the appended claims be interpreted as covering all alterations and modifications as fall within the true spirit and scope of the invention.

What is claimed is:

1. Method for assembling a sealed-type scroll compressor having a stationary scroll member to be fixed to a frame and an orbiting scroll member to be engaged with said stationary scroll member, said method comprising the steps of:

temporarily positioning said stationary scroll member on said frame to come into engagement with said orbiting scroll member;

relatively positioning one of said scroll members with respect to the other scroll member in a phase angle direction of wraps of said scroll members;

positioning said stationary scroll member with respect to said orbiting scroll member in X-direction and Y-direction of said scroll members;

shifting one of said scroll members, which has a coefficient of thermal expansion smaller than the other scroll member, in an orbiting direction of said orbiting scroll member by a predetermined phase angle; and fixing said stationary scroll member to said frame.

2. Method for assembling a sealed-type scroll compressor in accordance with claim 1, wherein a radius of a base circle of a wrap of said the other scroll member is made smaller than that of said one of scroll members.

* * * * *